US008317981B2

(12) United States Patent
Sasaki et al.

(10) Patent No.: US 8,317,981 B2
(45) Date of Patent: Nov. 27, 2012

(54) SUPPORT STRUCTURE OF A COKE DRUM

(75) Inventors: Yasuhiko Sasaki, Ehime (JP); Shinta Niimoto, Ehime (JP)

(73) Assignee: Sumitomo Heavy Industries Process Equipment Co., Ltd., Ehime (JP)

( * ) Notice: Subject to any disclaimer, the term of this patent is extended or adjusted under 35 U.S.C. 154(b) by 0 days.

(21) Appl. No.: 13/496,901

(22) PCT Filed: Oct. 15, 2009

(86) PCT No.: PCT/JP2009/005394

§ 371 (c)(1),
(2), (4) Date: Mar. 19, 2012

(87) PCT Pub. No.: WO2011/045843

PCT Pub. Date: Apr. 21, 2011

(65) Prior Publication Data

US 2012/0175238 A1 Jul. 12, 2012

(51) Int. Cl.

| | |
|---|---|
| ***C10B 55/00*** | (2006.01) |
| ***C10B 29/04*** | (2006.01) |
| ***C10B 29/08*** | (2006.01) |

(52) U.S. Cl. ..... 202/266; 202/268

(58) Field of Classification Search ..... 202/84, 202/120, 252, 239, 266, 267.1, 268, 270; 196/107, 130; 432/251; 220/635, 638, 647; 248/440

See application file for complete search history.

(56) References Cited

U.S. PATENT DOCUMENTS

| | | | | |
|---|---|---|---|---|
| 2,262,960 | A * | 11/1941 | Osterman | 432/249 |
| 3,167,486 | A * | 1/1965 | Bergman | 196/133 |
| 5,891,310 | A * | 4/1999 | Nelsen | 201/10 |
| 7,666,279 | B2 * | 2/2010 | Cihlar et al. | 202/239 |
| 7,871,500 | B2 * | 1/2011 | Lah | 202/266 |
| 8,221,591 | B2 * | 7/2012 | De Para et al. | 202/266 |
| 2007/0215452 | A1 | 9/2007 | Cihlar et al. | |
| 2007/0284239 | A1 * | 12/2007 | Chen | 202/102 |

FOREIGN PATENT DOCUMENTS

| | | |
|---|---|---|
| JP | 2002-508798 | 3/2002 |
| JP | 2002-515089 | 5/2002 |
| JP | 2007-277541 | 10/2007 |
| WO | WO98/59017 | 12/1998 |
| WO | WO99/13023 | 3/1999 |

OTHER PUBLICATIONS

International Search Report mailed on Jan. 19, 2010.

* cited by examiner

*Primary Examiner* — Jill Warden
*Assistant Examiner* — Joye L Woodard
(74) *Attorney, Agent, or Firm* — IPUSA, PLLC

(57) ABSTRACT

A support structure of a coke drum including a cylindrical drum body, an inverted-cone-shaped bottom plate connected to a bottom of the drum body, and a cylindrical skirt supporting the drum body includes an annular joining piece joining the drum body, the bottom plate, and the skirt to one another. The joining piece is a unitary member including an upper body part joined to a lower end of the drum body, a lower inner leg part joined to an upper end of the bottom plate, and a lower outer leg part joined to an upper end of the skirt.

8 Claims, 12 Drawing Sheets

(A)

(B)

| | CONVENTIONAL | EMBODIMENT 4 | EMBODIMENT 1 | EMBODIMENT 2 | EMBODIMENT 3 |
|---|---|---|---|---|---|
| ① CONNECTING ANGLE $\alpha$ | 5° ~ 12° | 1° ~ 5° | 0.94° | 0.23° | 0.94° |
| ②PLATE THICKNESS SHAPE CHANGE RATE L1/L2 | 1.0 | 1.0 | 1.8 | 2.1 | 1.8 |
| ③VERTICAL DIMENSION RATIO L1/L3 | APPROX. 0.1~0.2 | APPROX. 0.2~0.3 | 0.48 | 0.54 | 0.48 |

(A)

(B)

(A)

(B)

(A)

(B)

SUPPORT STRUCTURE OF A COKE DRUM

TECHNICAL FIELD

The present invention relates to a support structure of a coke drum. More specifically, a coke drum is a pressure vessel used in oil refineries, and is a piece of equipment subjected to temperatures varying between approximately 100° C. and approximately 500° C. during operations. The present invention relates to a support structure of a coke drum that reduces damage caused by thermal stress due to such varying temperatures.

BACKGROUND ART

FIG. 10 illustrates a general view of a coke drum A. A drum body 1 has a cylindrical shape. A head plate 2 is attached to the top of the drum body 1. An inverted-cone-shaped bottom plate 3 is formed at the bottom of the drum body 1. A cylindrical skirt 4 is attached around the boundary between the drum body 1 and the bottom plate 3. This skirt 4 is a support member for the coke drum A, and is configured to be fixed onto a concrete foundation 5 with bolts or the like.

The coke drum, which is a cylindrical vessel, has the following features in particular.

1) Thin and large in diameter

A pyrolytic reaction that occurs in the coke drum does not require a high pressure inside the vessel. A consecutive pyrolytic reaction is caused by putting in heated residual oil (the design pressure of the coke drum: 0.5 MPa [approximately 5 atm]). Because of a low design pressure, the coke drum may be reduced in plate thickness to result in a pressure vessel thin-walled and large in diameter. For other pressure vessels such as reactors, where a chemical reaction is caused by causing the internal pressure of the vessel to be high, the design pressure is as high as approximately 1 MPa to approximately 10 MPa (approximately 10 atm to approximately 100 atm).

2) Repetitive thermal cycle between approximately 100° C. and approximately 500° C. (cycle time: 12 hours to 24 hours)

There is no concept of "metal fatigue" due to thermal cycle repeated loading for common pressure vessels, which are maintained in a certain high-temperature state once operation is started.

On the other hand, the coke drum is a unique vessel repeatedly subjected to a thermal cycle of approximately 100° C. to approximately 500° C. to approximately 100° C. in an extremely short cycle of 12 hours to 24 hours in its regular operation. Therefore, the drum repeats expansion and contraction during operations, so that there is a problem in that the attachment part of a skirt is subjected to the load of thermal stress of extremely large amplitude, and is likely to be damaged by "metal fatigue."

3) Damage due to metal fatigue becoming apparent

The concept of "metal fatigue" due to thermal cycle repeated loading is unique to the coke drum, which operates with varying temperature in a short period of time, among the pressure vessels.

4) Increase in fatigue damage due to shortened cycle time

Users have been trying to reduce operating cycle time in order to make profits from producing more light oil and coke through refining in a shorter period of time. A shortened operating cycle results in reduction in heating and cooling time, thus causing sharp changes over time in the temperature distribution near the attachment part of the skirt. This leads to "generation of a greater thermal stress," thus increasing fatigue damage.

5) No establishment of a design method that considers metal fatigue as a limit state It is necessary from Item 2) above to design a coke drum in consideration of "metal fatigue" due to thermal cycle repeated loading, but such a designing method is not yet established. As a result of not taking metal fatigue due to a thermal cycle into consideration in designing, the occurrence of fatigue damage have been reported in many cases. Like for other pressure vessels, however, designing considers only static temperature and pressure, a dead load, a seismic load, a wind load, etc.

6) Extremely heavy operating-time dead load of 2000 tons to 3000 tons

The operating-time dead load is extremely heavy because of residual oil and water put inside.

As described above, there are circumstances that are unique to the coke drum and are not shared by common pressure vessels. A typical conventional skirt support structure is as illustrated in FIG. 11. A curved thick steel plate is formed from the vertical drum body 1 to the sloped bottom plate 3. The upper end of the skirt 4 is welded to the neighborhood of the upper end of the bottom plate 3 (that is, the boundary with the drum body 1). Reference sign 6 denotes the weld.

As described above, the coke drum is subjected to repeated heating and cooling. As illustrated in FIG. 12, the coke drum bulges outward near the joint part above the skirt 4, but does not move below the skirt 4 because the temperature does not increase (does not become high), so that high stress is generated in the joint part (see the drawing of (A)). On the other hand, when the temperature decreases at a cooling time, the coke drum tries to return inward above the skirt 4, but also tries to keep the high-temperature state below the skirt 4, so that a deformation opposite to that of the drawing (A) remains (see the drawing of (B)). According to the conventional art, by repeating such expansion and contraction, cracks are likely to be caused at the upper end of the attachment part of the skirt 4, that is, near the weld, as indicated by sign C in FIG. 11.

Therefore, the attachment part of the skirt has a short useful service life, and may suffer from generation of cracks as early as in about ten years.

Further, the conventional art of FIG. 11, which performs joining only by welding, thus making it important to control the quality of the weld, has a disadvantage in that the durability depends on quality including the presence or absence of a welding defect and the finished state of welding.

Patent Documents 1 and 2 illustrate conventional art for support structures of coke drums.

The coke drum of Patent Document 1 has an annular jacket formed around where a skirt is welded to a drum. Cooling fluid is caused to flow through the jacket during a quenching process during operations to reduce metal stress around the weld.

The coke drum of Patent Document 2 supports the bottom part of a drum vessel using a support element that provides a large contact surface. The support element has a bearing portion that tapers inward beneath a knuckle that separates from the sloped lower section of the drum vessel. The bearing portion is a funnel-shaped member that extends along the sloped surface of the drum vessel, and has a large contact surface. The support element has a narrow lower portion fixed onto a foundation with bolts.

However, the conventional art of Patent Document 1, which makes it necessary to cause cooling fluid to flow through the jacket at the time of a quenching process, has a disadvantage in that running costs are necessary.

Further, according to the conventional art of Patent Document 2, it is difficult to ensure such manufacturing accuracy as to cause the drum vessel and the support element to be in surface contact. In practice, the support element does not come into surface contact but only comes into point or liner contact with the bottom part of the drum vessel. The contact pressure is high where contact is made with a narrow area as in this case. Thus, there is a disadvantage in that deformation or distortion is likely to occur, so that there has been no case of its practical use.

PRIOR ART DOCUMENTS

Patent Documents

Patent Document 1: Japanese National Publication of International Patent Application No. 2002-515089

Patent Document 2: Japanese Laid-Open Patent Application No. 2007-277541

SUMMARY OF THE INVENTION

Problems to be Solved by the Invention

The coke drum has the above-described six qualities, so that in the case of attaching a member to the drum body by welding, a crack may be caused by metal fatigue to extend to the drum body. Therefore, it is a hard-and-fast rule of the coke drum to reduce members to be welded to the drum body as much as possible.

In view of the above-described circumstances, the present invention has an object of providing a support structure of a coke drum that improves the durability of the joint part of the skirt of the coke drum.

Means for Solving the Problems

According to a first aspect of the present invention, a support structure of a coke drum including a cylindrical drum body, an inverted-cone-shaped bottom plate connected to a bottom of the drum body, and a cylindrical skirt supporting the drum body includes an annular joining piece joining the drum body, the bottom plate, and the skirt to one another, wherein the joining piece is a unitary member including an upper body part joined to a lower end of the drum body, a lower inner leg part joined to an upper end of the bottom plate, and a lower outer leg part joined to an upper end of the skirt.

According to a second aspect of the present invention, in the support structure of the coke drum, the joining piece may have the lower outer leg part vertically extending downward from the upper body part, and may have the lower inner leg part extending downward and obliquely inward from the upper body part, and the lower inner leg part and the lower outer leg part may have respective inside edge upper end parts thereof defined by a curved connecting line.

According to a third aspect of the present invention, the support structure of the coke drum may further include a heat insulating material stuck on respective surfaces of the drum body, the bottom plate, the skirt, and the joining piece, wherein a space surrounded by the lower inner leg part and the lower outer leg part in the joining piece and a space continuing therefrom and surrounded by a part of the bottom plate and a part of the skirt define a hot box on which the heat insulating material is not stuck.

According to a fourth aspect of the present invention, in the support structure of the coke drum, the inside edge upper end parts of the lower inner leg part and the lower outer leg part in the joining piece may be defined by a part of a circle.

According to a fifth aspect of the present invention, in the support structure of the coke drum, the curved connecting line defining the inside edge upper end parts of the lower inner leg part and the lower outer leg part may be positioned higher than in a case of defining the inside edge upper end parts of the lower inner leg part and the lower outer leg part by a part of a circle.

According to a sixth aspect of the present invention, in the support structure of the coke drum, a part of a circle connected to an inside edge of the lower inner leg part and a part of an ellipse connected to an inside edge of the lower outer leg part may be connected to define the curved line.

According to a seventh aspect of the present invention, in the support structure of the coke drum, the curved line may be a parabola connected to an inside edge of the lower inner leg part and an inside edge of the lower outer leg part.

According to an eighth aspect of the present invention, in the support structure of the coke drum, a part of a circle connected to an inside edge of the lower inner leg part and a part of an ellipse connected to an inside edge of the lower outer leg part may be connected to define the curved line, and a thick part greater in thickness than the skirt may be formed on an inside edge side of the lower outer leg part.

Effects of the Invention

According to the first aspect, the joining piece has a monolithic form, and the drum body, the bottom plate, and the skirt are combined by welding with this joining piece. Since welds are distant from a stress concentration point, fatigue endurance is improved. Further, the monolithic shape of the joining piece may be cut out by machining, so that it is possible to obtain a shape less likely to allow stress concentration to occur. Accordingly, from this point as well, a highly durable support structure is obtained. Further, the joining piece may be combined with the drum body, its bottom part, and the skirt by butt welding, Therefore, no such high contact pressure as in-the case of surface contact is generated, nor is there generated a deformation or distortion resulting from such a high contact pressure. Further, there is no need to supply cooling fluid or the like during operations, so that no running costs are necessary.

According to the second aspect, both the upper body part and the lower outer leg part are vertical, Therefore, the weight of the drum body is transmitted vertically downward to the skirt via the upper body part and the lower outer leg part, so that no bending moment is exerted on the support structure. Accordingly, a highly durable support structure is obtained.

According to the third aspect, the presence of the hot box allows heat to be quickly conducted from the lower inner leg part to the lower outer leg part of the joining piece to reduce a difference in temperature between the drum body and the skirt. Without the hot box, the difference in temperature between the drum body and the skirt would increase to generate a high thermal stress because the thermal conduction of steel alone cannot transmit temperature to the lower side of the skirt attachment part although steel has a high thermal conductivity. However, since the temperature difference is reduced as described above, thermal stress is reduced and a crack is less likely to be caused. Accordingly, a highly durable support structure is obtained.

According to the fourth aspect, the shape is less likely to allow stress concentration to occur in addition to the thermal stress reducing effect due to the hot box. That is, while stress due to the expansion and contraction of the skirt caused by the heating and cooling of the coke drum is generated in the inside edge upper end parts interfacing the lower inner leg part and the lower outer leg part of the joining piece, these inside edge upper end parts are defined by a part of a circle so that stress concentration is less likely to occur and a crack is less likely to be caused in the inside edge upper end parts. Therefore, higher durability is obtained.

According to the fifth aspect, the inside edge upper end parts of the lower inner leg part and the lower outer leg part of the joining piece are positioned above the inside edge upper end parts according to the fourth aspect, so that the hot box is larger in the upward direction, This results in a wider range of temperatures followable from the drum body to the skirt, thus increasing an area deformable in response to the expansion and contraction deformation of the drum body in operation. As a result, stress generated in the skirt or the joining piece is reduced, so that durability is improved.

According to the sixth aspect, the curved line connecting the inside edge of the lower inner leg part and the inside edge of the lower outer leg part is a part of a circle and a part of an ellipse that are connected, so that the connecting angle of the curved line relative to the inside edge of the lower outer leg part is reduced. This further relaxes stress concentration, thus resulting in higher durability.

According to the seventh aspect, the curved line connecting the inside edge of the lower inner leg part and the inside edge of the lower outer leg part is a parabola, so that the connecting angle of the curved line relative to the inside edge of the lower outer leg part is reduced. This further relaxes stress concentration, thus resulting in higher durability.

According to the eighth aspect, like in the sixth aspect, a reduced connecting angle of the curved line further relaxes stress concentration. In addition, the lower outer leg part includes a thick part that is large in thickness. This improves bending rigidity so that generated stress is further reduced.

DESCRIPTION OF EMBODIMENTS

Next, a description is given, based on drawings, of embodiments of the present invention.

Figure 1:
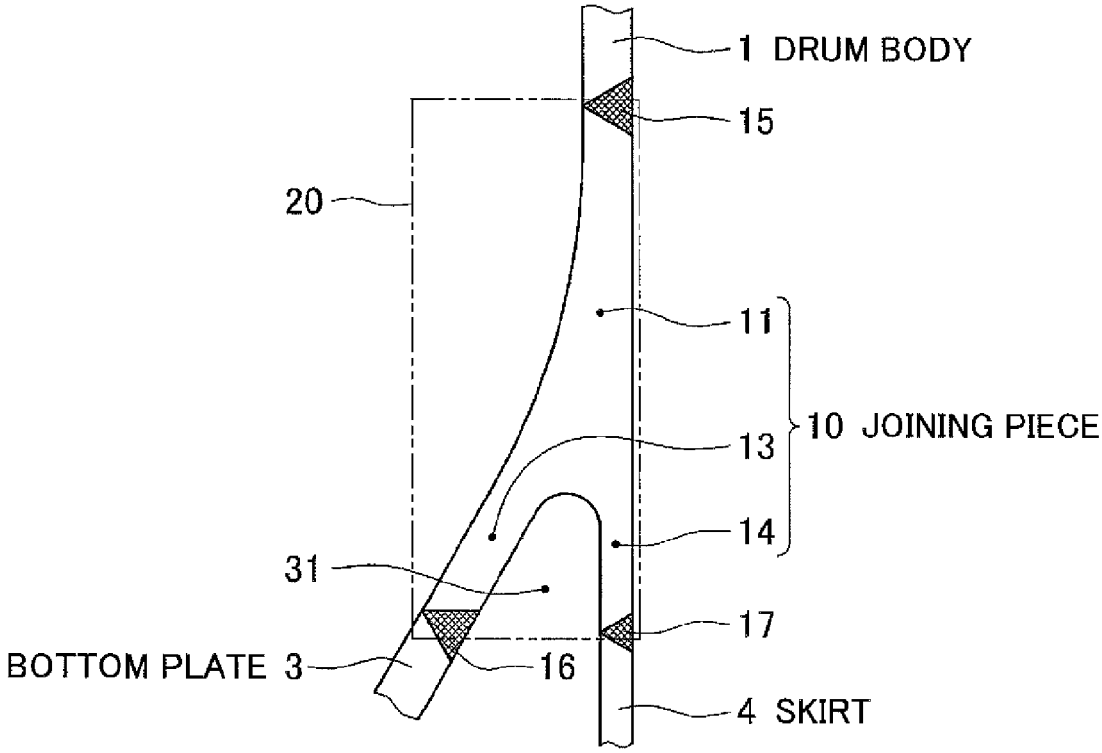
FIG. 1 is a diagram illustrating a joining piece according to the present invention.

In FIG. 1, a joining piece is denoted by 10. A coke drum for which the joining piece 10 of the present invention is used also includes the cylindrical drum body 1, the inverted-cone-shaped bottom plate 3 connected to the bottom of the drum body 1, and the cylindrical skirt 4. The drum body 1 and the bottom plate 3 are not continuous, and are combined via the joining piece 10. Usually, steel plates forming the drum body 1 and the bottom plate 3 re approximately 30 mm to approximately 50 mm in thickness, and a steel plate forming the skirt 4 is approximately 20 mm to approximately 30 mm in thickness.

The joining piece 10 is a member having a monolithic body, and includes an upper body part 11 joined to the lower end of the drum body 1, a lower inner leg part 13 joined to the upper end of the bottom plate 3, and a lower outer leg part 14 joined to the upper end of the skirt 4. The upper body part 11 and the lower inner leg part 13 are equal in thickness to the drum body 1 and the bottom plate 3, respectively. The lower outer leg part 14 is equal in thickness to the skirt 4.

The lower outer leg part 14 extends downward from the upper body part 11. Both the upper body part 11 and the lower outer leg part 14 are formed to be vertical to define a single-plane exterior surface. The lower inner leg part 13 also extends downward from the upper body part 11. The lower inner leg part 13 is inclined obliquely inward relative to the lower outer leg part 14. The angle of inclination of the lower inner leg part 13 is the same as the angle of inclination of the bottom plate 3.

This structure causes a space 31 to be formed between the lower inner leg part 13 and the lower outer leg part 14, and makes it possible to configure a below-described hot box 30.

The upper body part 11 of the joining piece 10 is combined with the lower end of the drum body 11 by welding. Sign 15 denotes a weld resulting therefrom. The lower inner leg part 13 is combined with the bottom plate 3 by welding. Sign 16 denotes a weld resulting therefrom. The lower outer leg part 14 also is combined with the skirt 4 by welding. Sign 17 denotes a weld resulting therefrom.

Each of the three welds 15, 16, and 17 is distant from the neighborhood of the root of the lower outer leg part relative to the upper body part 11, on which thermal stress is likely to concentrate. Therefore, cracks are less likely to be caused by thermal stress in the welds 15, 16, and 17. This is one of the reasons for high durability even with welding.

Next, a description is given of a method of manufacturing the joining piece 10. In FIG. 1, sign 20 denotes a material having a rectangular cross section before cutting out the joining piece 20.

Figure 2:
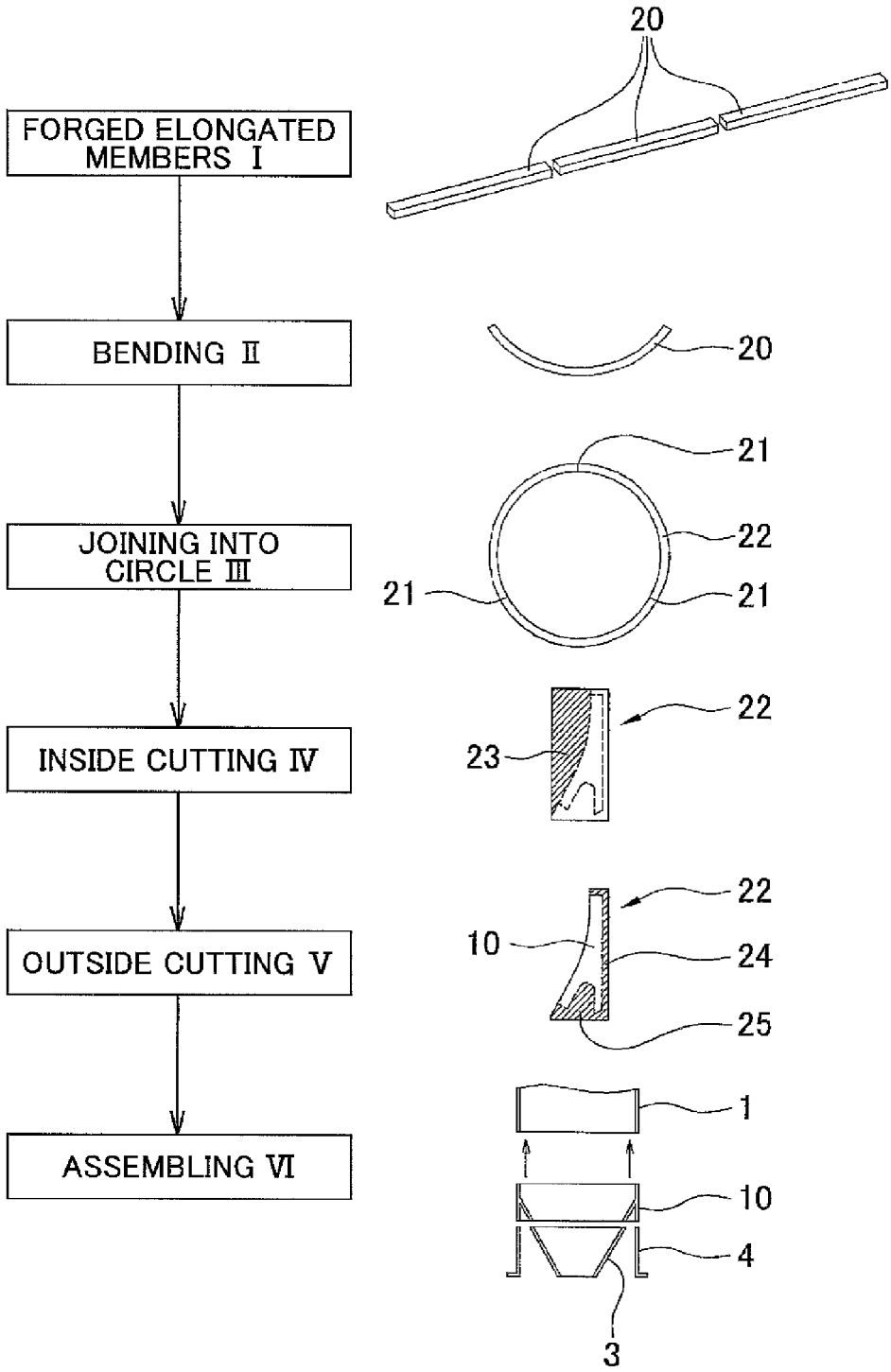
FIG. 2 is a diagram illustrating a method of manufacturing a joining piece according to the present invention.

FIG. 2 illustrates a manufacturing method, and the joining piece 10 is manufactured in the following process.

I. Steel elongated members 20 are formed by forging or the like. Their cross sections are rectangular. The number of elongated members 20 used, which is three in the illustrated case, is arbitrary.

II. The elongated members 20 are bent and curved.

III. The three curved elongated members are combined by welding into a circular ring 22 at this stage.

IV. An inner portion 23 of the circular ring 22 is cut off by machining.

V. An outer portion 24 and a lower portion 25 are cut off.

By the above-described cutting processes IV and V, the joining piece 10 of the present invention is obtained. This means that inside edge upper end parts interfacing the lower inner leg part 13 and the lower outer leg part 14 may be freely shaped by cutting. Therefore, it is possible to form a shape effective for reducing thermal stress and a hot box by cutting out the inside edge upper end parts with an appropriate curved line.

VI. Once the joining piece 10 is cut out, the drum body 1 and the bottom plate 3 are welded and combined via this joining piece 10, and the skirt 4 also is combined by welding.

Figure 3:
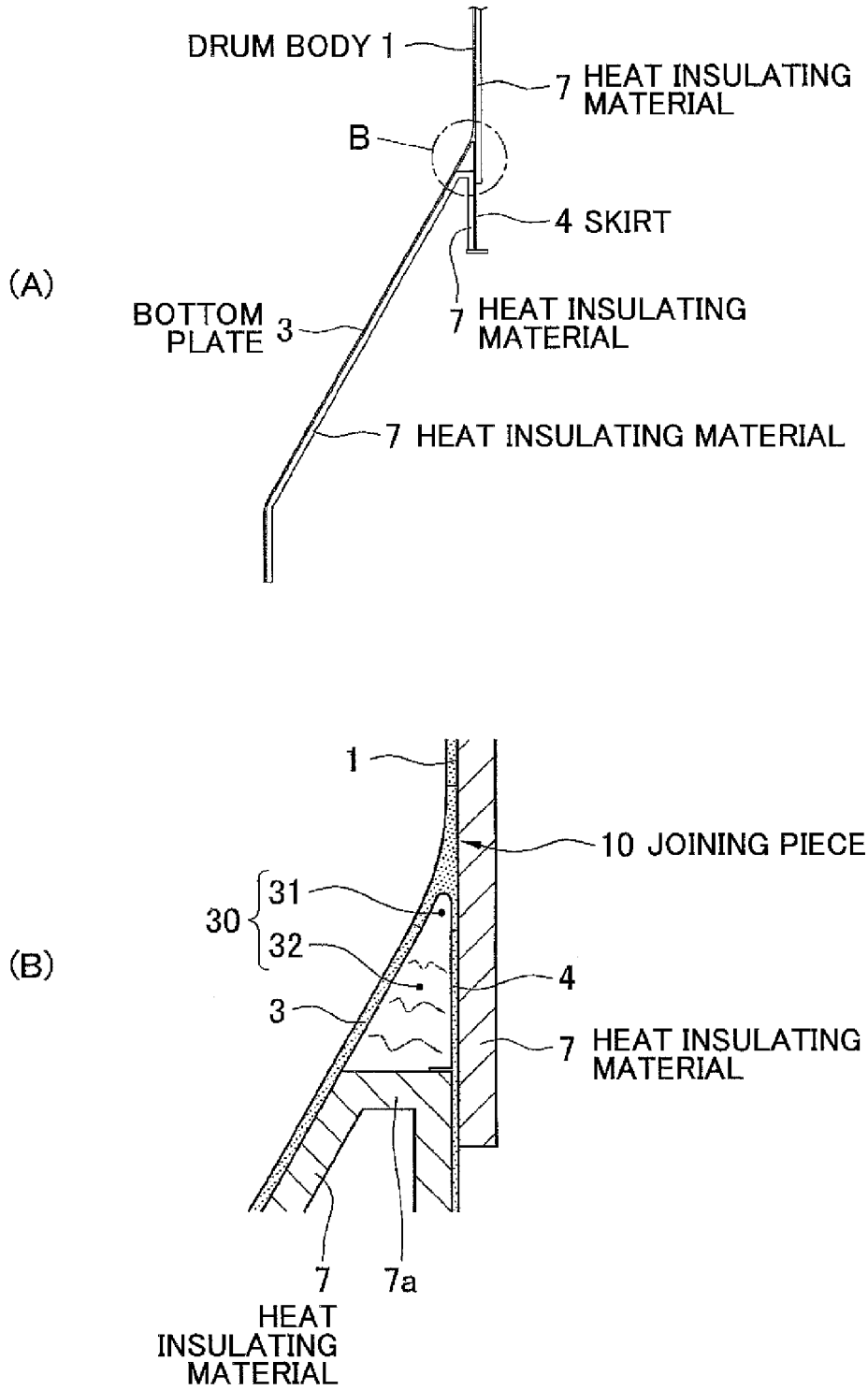
FIG. 3(A) is a diagram illustrating a position of a hot box.
FIG. 3(B) is a diagram illustrating a structure of the hot box.

FIG. 3 is a diagram illustrating the hot box 30. As illustrated in the drawing of (A), a heat insulating material 7 is stuck on the exterior surface of the drum body 1, the exterior surface of the bottom plate 3, and both the interior surface and the exterior surface of the skirt 4. Further, as illustrated in the drawing of (B), the heat insulating material 7 is stuck on the exterior surface of the upper body part 11 and the exterior surface of the lower outer leg part 14 of the joining piece 10.

On the other hand, the heat insulating material 7 is not stuck on the interior surface of the upper body part 11, the interior surface and the exterior surface of the lower inner leg part 13, or the interior surface of the lower outer leg part 14 of the joining piece 10.

A heat insulating material 7*a* is laterally disposed from an intermediate portion of the skirt 4 in its height direction to the bottom plate 3.

Known glass wool or rock wool is used as the heat insulating material 7.

According to this configuration, in a space combining a space 31 between the lower inner leg part 13 and the lower outer leg part 14 of the joining piece 10 and a space 32 continuing downward from the space 31, surrounded by the bottom plate 3, the skirt 4, and the heat insulating material 7*a*, air is present with little air moving in from or out to the outside, and the hot box 30 is defined that is thermally insulated by the heat insulating materials 7 and 7*a*.

Figure 4:
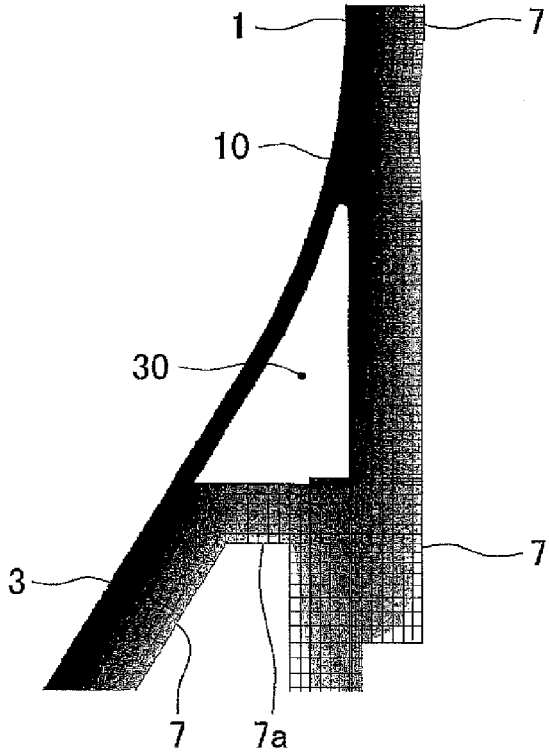
FIG. 4(A) is a diagram of a temperature distribution around the hot box.
FIG. 4(B) is a diagram illustrating an effect of the hot box.
Figure 4:
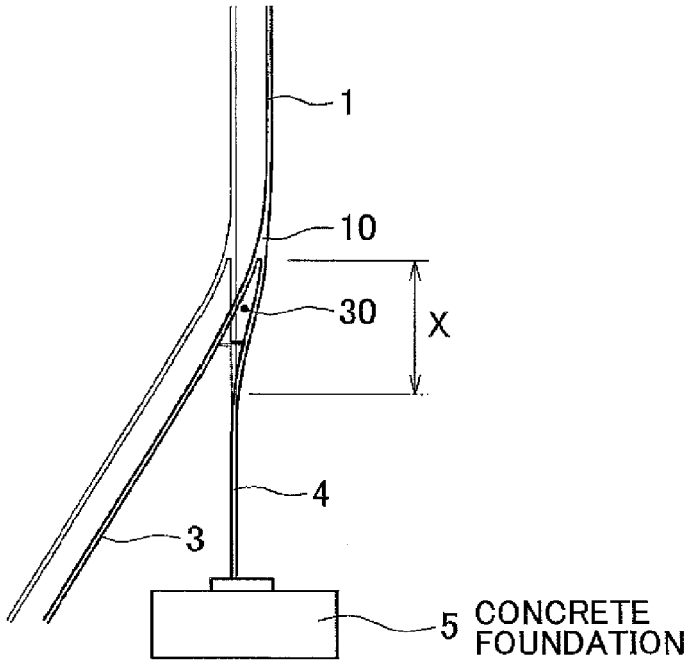

Heat is transferred by heat radiation around the hot box 30, so that heat distribution around the hot box at a high-temperature time is as illustrated in FIG. 4(A). That is, the temperature is high in the drum body 1, the bottom plate 3, and the joining piece 10 on the interior side, which are subjected directly to heat (high density portion), while the temperature is medium in part of the skirt 4 that faces the hot box 30 (intermediate density portion) and is low below the hot box 30 (low density portion).

As described above, temperature propagates quickly in the part of the hot box 30. An upper portion of the skirt 4 near the hot box 30 becomes high in temperature earlier than a lower portion of the skirt 4.

Therefore, as denoted by sign X in FIG. 4(B), the skirt 4 bulges outward near the hot box 30. However, since the deformation resistance is low because of high temperature, the stress of the lower outer leg part 14 of the joining piece 10 is reduced. In particular, a stress generated at the terminal end part of the curved line in the lower outer leg part 14 (a position where the curved line connects to the inside edge of the lower outer leg part, of which a description is given in detail below) is reduced.

Figure 5:
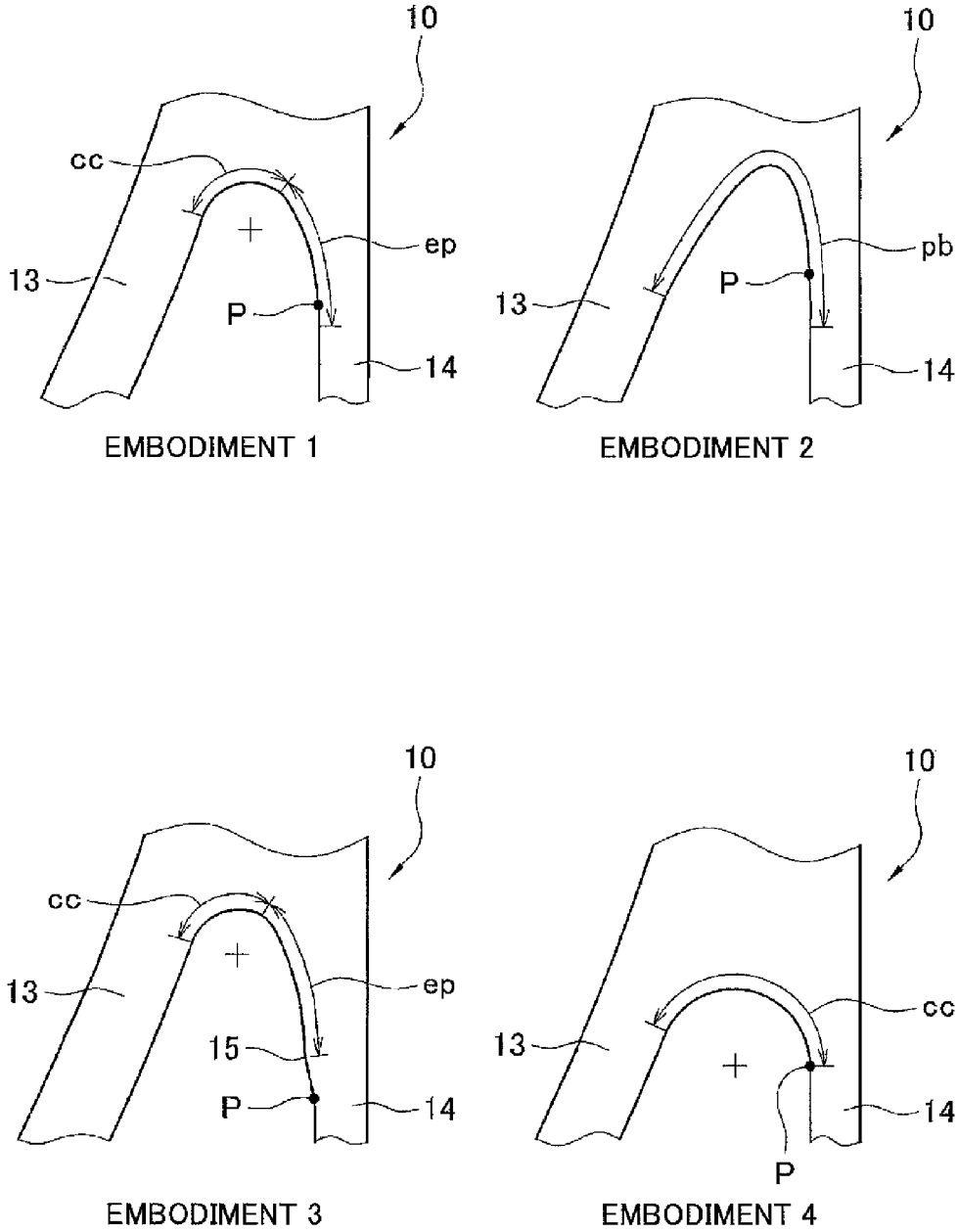
FIG. 5 is a diagram illustrating structures of joining pieces of Embodiments (1) to (4).

Next, a description is given, based on FIG. 5, of embodiments of the joining piece 10.

(1) Embodiment 1

The inside edge upper end parts of the lower inner leg part 13 and the lower outer leg part 14 in the joining piece 10 are defined by a curved line positioned above the inside edge upper end parts of Embodiment 4.

A part of a circle, cc, connected to the inside edge of the lower inner leg part 13 and a part of an ellipse, ep, connected to the inside edge of the lower outer leg part 14 are connected to define this curved line. A stress concentration point P is near the terminal end part where the curved line ep connects to the inside edge of the lower outer leg part 14.

(2) Embodiment 2

The inside edge upper end parts of the lower inner leg part 13 and the lower outer leg part 14 in the joining piece 10 are defined by a curved line positioned above the inside edge upper end parts of Embodiment 4.

The curved line is a parabola pb that is connected to the inside edge of the lower inner leg part 13 and the inside edge of the lower outer leg part 14. The stress concentration point P is near the terminal end part where the parabola pb connects to the inside edge of the lower outer leg part 14.

(3) Embodiment 3

The inside edge upper end parts of the lower inner leg part 13 and the lower outer leg part 14 in the joining piece 10 are defined by a curved line positioned above the inside edge upper end parts of Embodiment 4.

The part of a circle, cc, connected to the inside edge of the lower inner leg part 13 and the part of an ellipse, ep, connected to the inside edge of the lower outer leg part 14 are connected to define this curved line. The stress concentration point P is near the terminal end part where the curved line ep connects to the inside edge of the lower outer leg part 14. A thick part 15, which is greater in thickness than the skirt 4, is formed in the lower outer leg part 14. The stress concentration point P is in this thick part 15.

(4) Embodiment 4

The inside edge upper end parts of the lower inner leg part 13 and the lower outer leg part 14 in the joining piece 10 are defined by the part of a circle, cc. The stress concentration point P is near the terminal end part where the curved line connects to the inside edge of the lower outer leg part 14.

Figure 6:
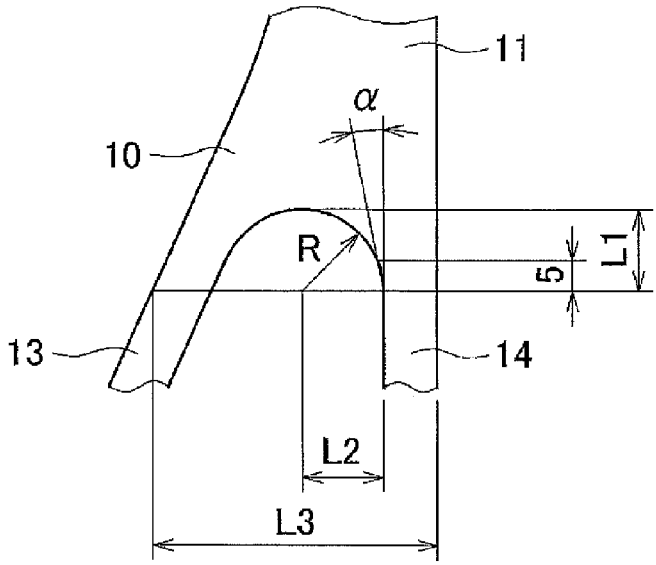
FIG. 6 is a diagram illustrating shapes of the joining pieces of Embodiments (1) to (4), where (A) is a dimension table and (B) is a diagram illustrating definitions.

A description is given in more detail, based on FIG. 6, of the joining pieces 10 of Embodiments 1 to 4.

The definitions of terms that describe features of each embodiment are as follows. Further, signs $\alpha$, L1, L2, and L3 are as illustrated in FIG. 6(B).

(1) Connecting Angle $\alpha$

An intersection angle to a vertical line at a position 5 mm above the terminal end part of the curved line.

The terminal end part is a position where the curved line connects to the inside edge of the lower outer leg part.

Stress concentration can be more relaxed with a smaller connecting angle.

(2) Plate Thickness Shape Change Rate L1/L2

L1: Distance from the terminal end part of the curved line to the apex of the inside edge upper end part.

L2: Distance from the curving center to the terminal end part.

If the plate thickness shape change rate is more than 1.0, it is possible to prevent a sudden change in shape from the joining piece to the skirt and to make the distribution of stress generation uniform.

(3) Vertical Dimension Ratio L1/L3

The ratio of the vertical dimension to the overall width L3 of the joining piece at the terminal end part.

As this ratio increases, the hot box increases in size and the skirt 4 increases in flexibility, thus making it possible to reduce generated stress.

Figure 11:
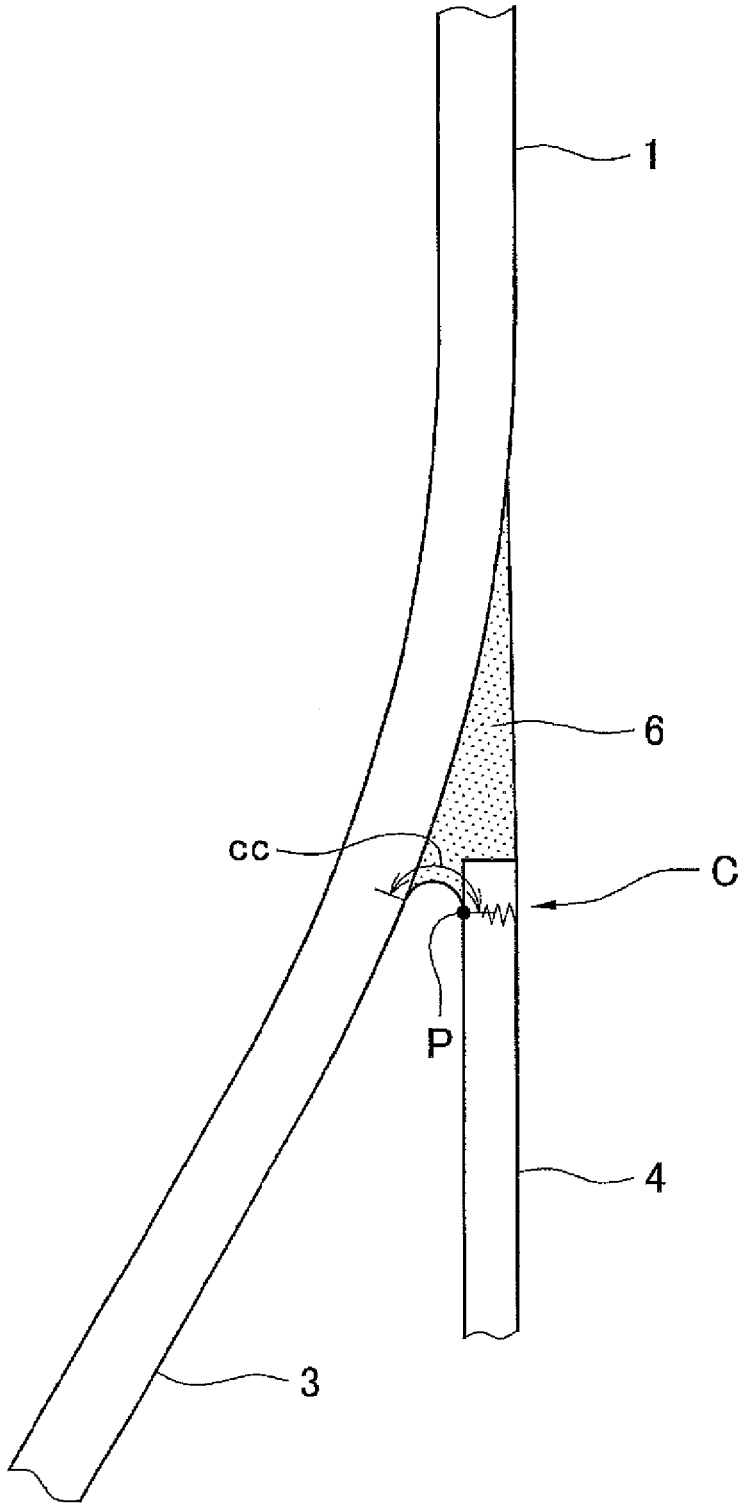
FIG. 11 is a diagram illustrating a conventional skirt joining structure.
Figure 12:
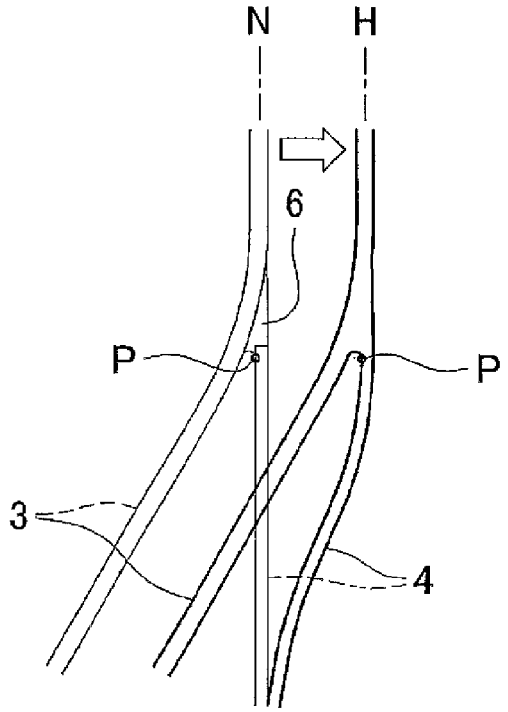
FIG. 12 is a diagram illustrating problems in the conventional case of FIG. 11, as shown in FIG. (12A) and (12B).
Figure 12:
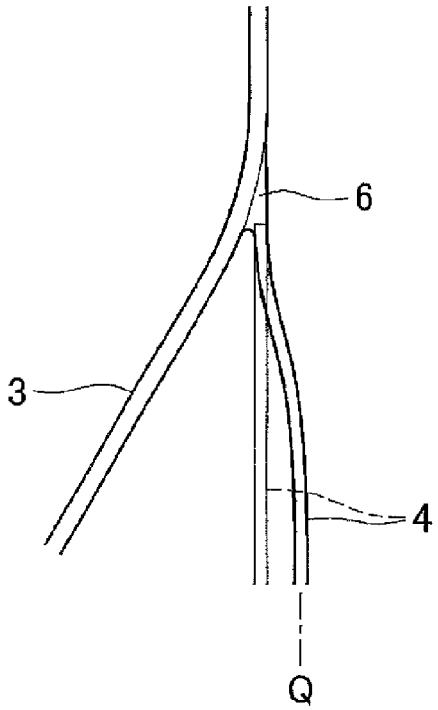

In each embodiment, the inside diameter R of the inside edge upper end part, etc., may be selected in accordance with the size of the joining piece 10. From the shape of the combination of the circle cc and the ellipse ep in the respective embodiments, it is possible to reduce the connecting angle α, increase the plate thickness shape change rate L1/L2, and increase the vertical dimension ratio L1/L3 compared with the conventional structure (FIG. 11).

Features common to Embodiments 1 to 3 are as follows.

a) In Embodiments 1 to 3, it is possible to make the connecting angle α less than or equal to 1.0°. As a result, metal fatigue strength becomes approximately 2.5 to approximately 3.3 times higher.

b) In Embodiments 1 to 3, structures are such that the plate thickness shape change rate is more than 1.0. Therefore, a sudden change in shape is less likely to be caused from the joining piece 10 to the skirt 4, so that it is possible to make the distribution of generated stress uniform.

c) In Embodiments 1 to 3, the apex of the inside edge upper end parts is higher than in Embodiment 4, so that the hot box is larger in vertical size. This allows a larger area to follow a sudden change in the temperature and the contraction and expansion deformation of the drum body in operation. As a result, the skirt has higher flexibility to relax generated stress.

d) In Embodiment 3, the thickness of a part of stress concentration is locally increased by the thick part 15. This improves bending rigidity to reduce generated stress.

A description is given, in comparison with Embodiment 1, of features of Embodiment 3.

Figure 7:
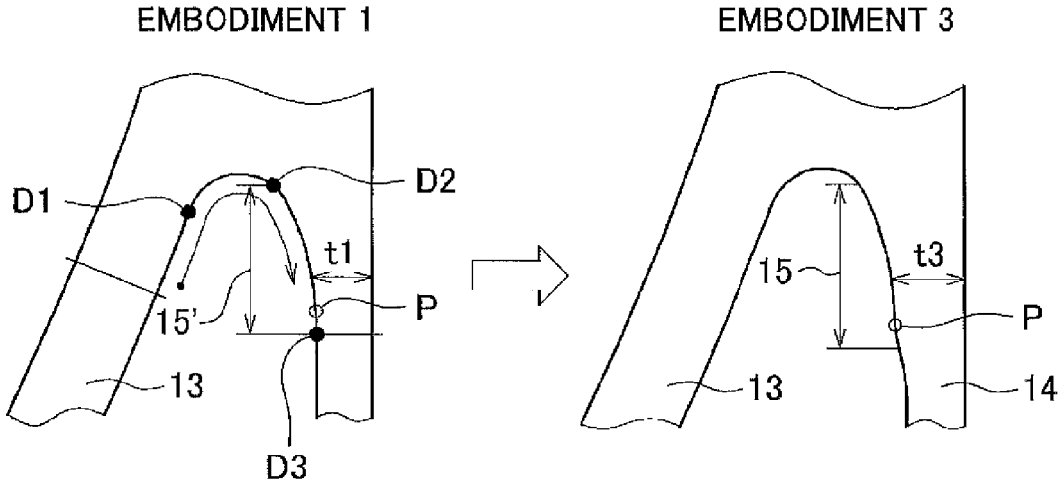
FIG. 7(A) is a diagram illustrating the structure of the joining piece of Embodiment (3) in contrast to Embodiment (1)
FIG. 7(B) is a diagram illustrating another type of Embodiment 3.
Figure 7:
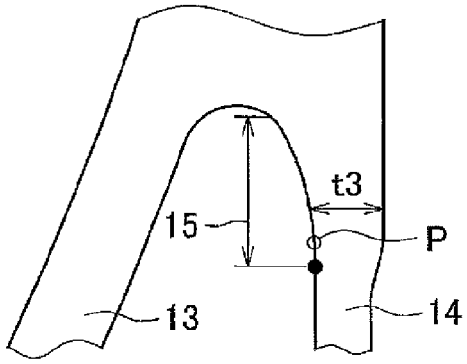

FIG. 7(A) illustrates Embodiment 1 on the left side. Signs D1, D2, and D3 indicate a starting point D1, an intermediate point D2, and a terminal end part D3 of the curved line. The stress concentration point P is located immediately above the terminal end part D3. FIG. 7(A) illustrates Embodiment 3 on the right side. Sign 15 denotes the thick part. As is clear from a comparison with a part of sign 15' of Embodiment 1, the thick part 15 of Embodiment 3 is characterized by a greater thickness near the stress concentration point P.

Embodiment 3 has a feature that a thickness t3 of the thick part 15 is greater than a thickness t1 of Embodiment 1. As long as the thickness t3 can be increased, the inside edge of the lower outer leg part 14 may be caused to bulge inward as illustrated on the right side in the drawing of (A) or the outside edge of the lower outer leg part 14 may be caused to bulge outward to increase the thickness t3 as illustrated in the drawing of (B).

Figure 9:
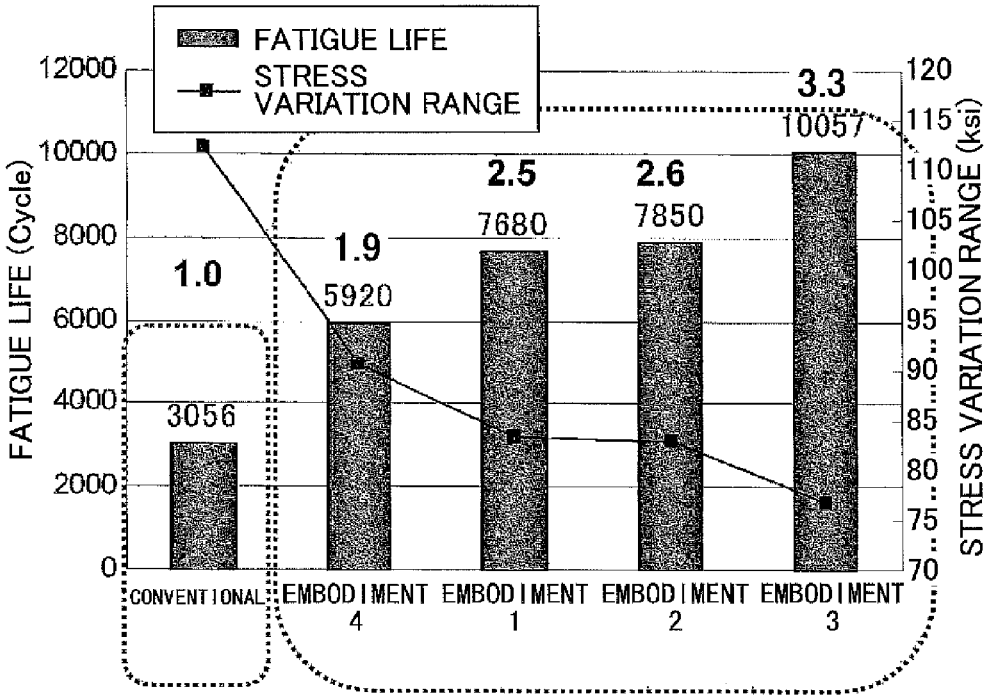
FIG. 9 is a graph illustrating the results of durability tests on coke drums of embodiments of the present invention.
Figure 10:
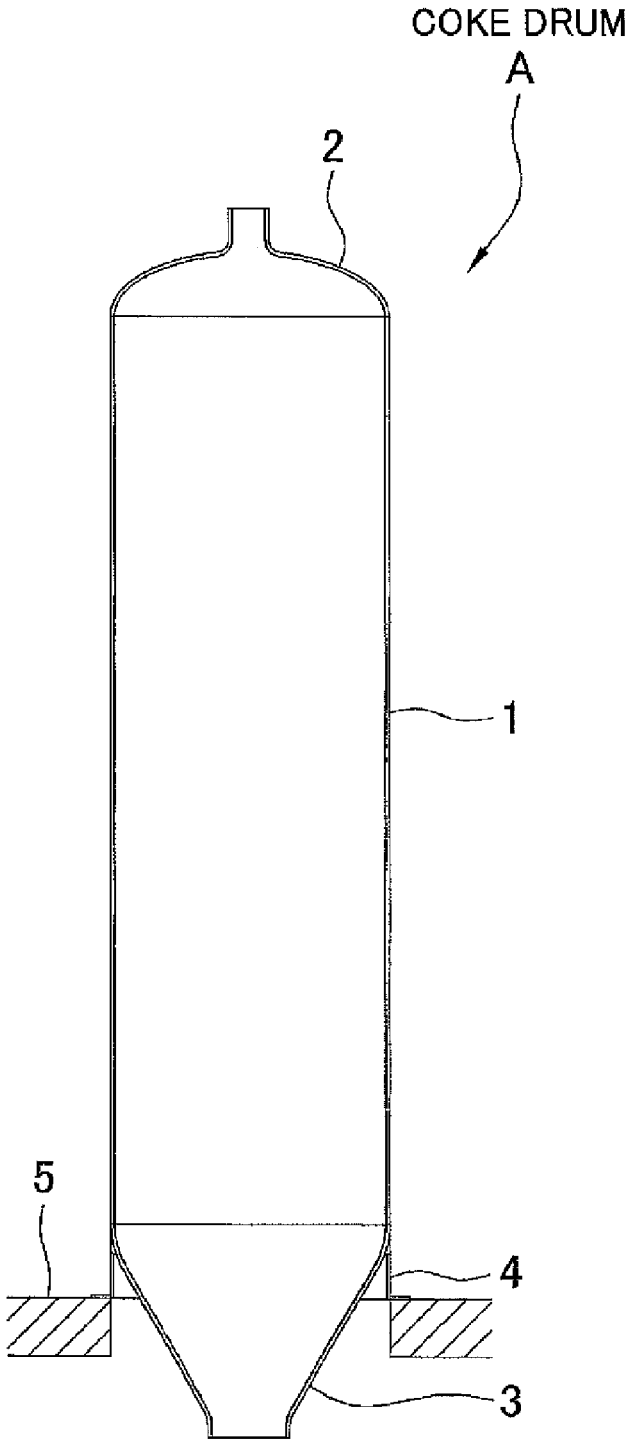
FIG. 10 is a diagram illustrating a basic configuration of a coke drum.

Compared with Embodiments 1 and 2, the thickness t3 of a part of stress concentration is locally increased by the thick part 15 in Embodiment 3. This results in an increase in bending rigidity and reduction in generated stress. Therefore, the metal fatigue life is longer in Embodiment 3 than in Embodiments 1 and 2 as illustrated in FIG. 9.

Figure 8:
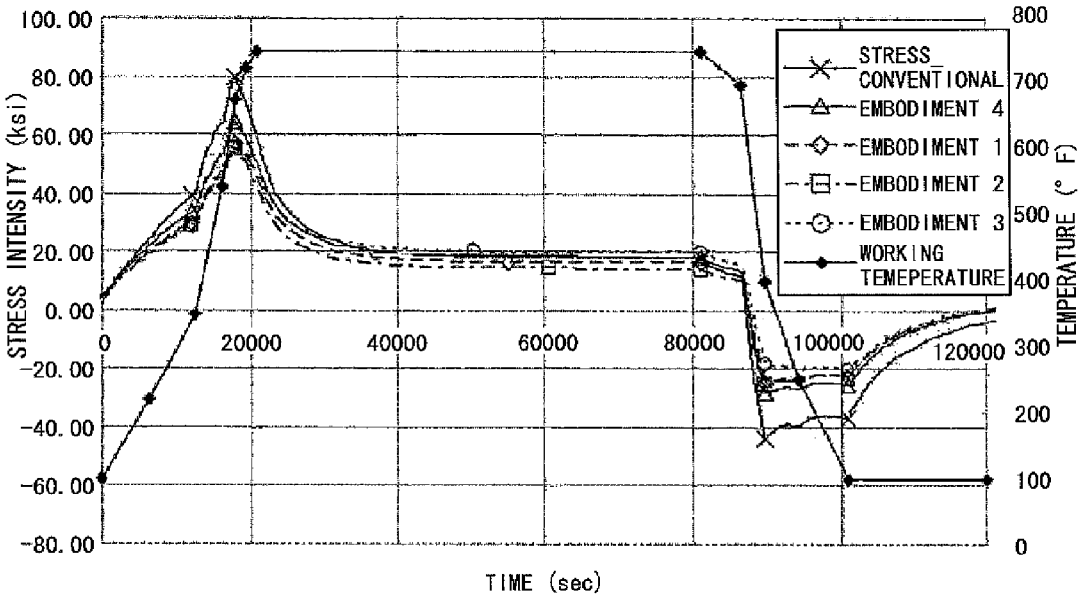
FIG. 8 is a diagram of temperature changes during the operation of the coke drum and thermal stresses of the conventional case and Embodiments 1 to 4.

FIG. 8 illustrates temperature changes during the operation of the coke drum and thermal stresses in the conventional case and Embodiments 1 to 4.

While the details are described below, in general, the range of thermal stress variations is more limited in Embodiments 1 to 4 than in the conventional art, and the capability of reducing thermal stress is higher in Embodiments 1 to 3 than in Embodiment 4.

A description is given in detail below.

As the temperature of the coke drum increases, the thermal stress increases up to 80 ksi in the conventional case and up to approximately 55 ksi to approximately 65 ksi in Embodiments 1 to 4. The operating temperature is kept constant after increasing, while the thermal stress decreases to approximately 20 ksi and thereafter remains substantially at the same level. Thereafter, with a decrease in the operating temperature, the thermal stress is further reduced. The thermal stress is reduced to the range of −20 ksi to −30 ksi in Embodiments 1 to 4 and to approximately −40 ksi in the conventional case. This phenomenon shows that compared with a wide range of thermal stress variations of 80 ksi to −40 ksi in the conventional case, in Embodiments 1 to 4, the variation range has an upper limit of 55 ksi to 65 ksi and a lower limit of −20 ksi to −30 ksi, thus being more limited than in the conventional case.

This means that Embodiments 1 to 4 are lower in thermal stress and higher in durability than the conventional case.

Further, making a comparison between Embodiments 1 to 3 and Embodiment 4 in FIG. 8, the upper limit value and the lower limit value of thermal stress are smaller, that is, the range of thermal stress variations is more limited, in Embodiments 1 to 3 than in Embodiment 4. This is due to the size of the hot box 30. In other words, the space 31 is greater, that is, the upper end of the space 31 is positioned higher, in Embodiments 1 to 3 than in Embodiment 4. Therefore, the volume of the hot box 30 is larger so that heat conduction is faster to make quick and flexible bending more likely in Embodiments 1 to 3 than in Embodiment 4.

The range of thermal stress variations appears to be more limited in Embodiment 3 than in Embodiments 1 and 2 in FIG. 8. This is because there is stress reduction due to formation of the thick part 15 in the lower outer leg part in Embodiment 3 as described above.

FIG. 9 is a graph showing the results of durability tests on coke drums according to the present invention, illustrating the results of an FEM analysis under the following conditions.

1) Analysis Conditions

Method: Thermal stress analysis

Model: 2-Axisymmetric model

Software: Abaqus/Standard

2) Applied Code

ASME Sec. VIII Div. 2 2007 edition

3) Test Conditions

The lower end of the skirt 4 was axially immovable and radially movable. The drum body and the bottom plate were non-rotatable.

4) Coke Drum Specifications

Steel Type 1.25% chromium-0.5% molybdenum steel (ASME standard: SA-387 Grade 11 Class 2)

Drum Body Inside Diameter 9800 mm

Bottom Plate Outlet Inside Diameter 1467 mm

5) Temperature Conditions

From start to 350 min.: Heating from approximately 100° F. (300° F./hr)

From 350 min. to 1350 min.: Maintaining temperature (approximately 750° F.)

From 1350 min. to 1750 min.: Cooling (350° F./hr)

FIG. 9 shows the number of times the above-described cycle was repeated before resulting in fatigue damage.

Compared with the durability of the conventional case, which is 3,056 times, Embodiments 1 to 4 of the present invention are as follows:

Embodiment 1: 7,680 times (approximately 2.5 times more)

Embodiment 2: 7,850 times (approximately 2.6 times more)

Embodiment 3: 10,057 times (approximately 3.3 times more)

Embodiment 4: 5,920 times (approximately 1.9 times more).

As described above, a support structure of a coke drum according to the present invention can show durability approximately two to approximately three times higher than that in the conventional case.

According to Embodiments 1 to 4 of the present invention, it is possible to combine a joining piece with a drum body, its bottom part, and a skirt by butt welding. Therefore, no such high contact pressure as in the case of surface contact is generated, nor is generated a deformation or distortion resulting from such a high contact pressure. Further, there is no need to supply cooling fluid or the like during operations, so that no running costs are necessary.

DESCRIPTION OF THE REFERENCE SIGNS

1 drum body
3 bottom plate
4 skirt
10 joining piece
11 upper body part
13 lower inner leg part
14 lower outer leg part
30 hot box

The invention claimed is:

1. A support structure of a coke drum including a cylindrical drum body, an inverted-cone-shaped bottom plate connected to a bottom of the drum body, and a cylindrical skirt supporting the drum body, wherein:

an annular joining piece joining the drum body, the bottom plate, and the skirt to one another is used, and the joining piece is a unitary member including an upper body part joined to a lower end of the drum body, a lower inner leg part joined to an upper end of the bottom plate, and a lower outer leg part joined to an upper end of the skirt.

2. The support structure of the coke drum as claimed in claim 1, wherein:

the joining piece has the lower outer leg part vertically extending downward from the upper body part, and has the lower inner leg part extending downward and obliquely inward from the upper body part, and the lower inner leg part and the lower outer leg part have respective inside edge upper end parts thereof connected by a curved connecting line.

3. The support structure of the coke drum as claimed in claim 2, wherein:

a heat insulating material is stuck on respective surfaces of the drum body, the bottom plate, the skirt, and the joining piece, and a space surrounded by the lower inner leg part and the lower outer leg part in the joining piece and a space continuing therefrom and surrounded by a part of the bottom plate and a part of the skirt define a hot box on which the heat insulating material is not stuck.

4. The support structure of the coke drum as claimed in claim 3, wherein the inside edge upper end parts of the lower inner leg part and the lower outer leg part in the joining piece are connected by a part of a circle.

5. The support structure of the coke drum as claimed in claim 4, wherein the inside edge upper end parts of the lower inner leg part and the lower outer leg part in the joining piece are defined by a curved line positioned above the inside edge upper end parts of claim 4.

6. The support structure of the coke drum as claimed in claim 5, wherein a part of a circle connected to an inside edge of the lower inner leg part and a part of an ellipse connected to an inside edge of the lower outer leg part are connected to define the curved line.

7. The support structure of the coke drum as claimed in claim 5, wherein the curved line is a parabola connected to an inside edge of the lower inner leg part and an inside edge of the lower outer leg part.

8. The support structure of the coke drum as claimed in claim 5, wherein:

a part of a circle connected to an inside edge of the lower inner leg part and a part of an ellipse connected to an inside edge of the lower outer leg part are connected to define the curved line, and a thick part greater in thickness than the skirt is formed on an inside edge side of the lower outer leg part.

* * * * *